US011691060B1

(12) United States Patent
Burns, III

(10) Patent No.: US 11,691,060 B1
(45) Date of Patent: Jul. 4, 2023

(54) ADJUSTABLE NET SYSTEM

(71) Applicant: EastPoint Sports Ltd., LLC, Succasunna, NJ (US)

(72) Inventor: James P. Burns, III, Cranford, NJ (US)

(73) Assignee: EastPoint Sports Ltd., LLC, Succasunna, NJ (US)

( * ) Notice: Subject to any disclaimer, the term of this patent is extended or adjusted under 35 U.S.C. 154(b) by 0 days.

(21) Appl. No.: 18/165,568

(22) Filed: Feb. 7, 2023

Related U.S. Application Data

(60) Provisional application No. 63/267,667, filed on Feb. 8, 2022.

(51) Int. Cl.
*A63B 61/04* (2006.01)
*A63B 61/00* (2006.01)
*A63B 61/02* (2006.01)

(52) U.S. Cl.
CPC ..... *A63B 61/003* (2013.01); *A63B 61/02* (2013.01)

(58) Field of Classification Search
CPC ..... A63B 61/003; A63B 61/02; A63B 61/04
See application file for complete search history.

(56) References Cited

U.S. PATENT DOCUMENTS

| | | | |
|---|---|---|---|
| 254,018 | A | 2/1882 | Johnson |
| 411,387 | A | 9/1889 | Manning |
| 425,568 | A | 4/1890 | Edelkamp |
| 714,411 | A | 11/1902 | Steinmetz |
| 724,686 | A | 11/1902 | Steinmetz |
| 748,407 | A | 12/1903 | McIntire |
| 809,083 | A | 1/1906 | Ackerman |
| 1,556,046 | A | 10/1925 | Muir |
| 1,995,543 | A | 3/1935 | Everett |
| 2,004,579 | A | 6/1935 | Lichtenstein |
| 2,147,502 | A | 2/1939 | Savage |

(Continued)

FOREIGN PATENT DOCUMENTS

| | | | | |
|---|---|---|---|---|
| CN | 107715419 A | * | 2/2018 | ..... A63B 61/00 |
| CN | 110064181 A | * | 7/2019 | |

(Continued)

OTHER PUBLICATIONS

Photograph of Pingpong the Original 3 in 1 pop-up table tennis set.

(Continued)

*Primary Examiner* — Raleigh W Chiu
(74) *Attorney, Agent, or Firm* — James A. Joyce; Godfrey & Kahn, S.C.

(57) ABSTRACT

Disclosed herein is an adjustable net system that includes a net having a first net end and a second net end, a net mesh portion, a first net end sleeve, a second net end sleeve, an upper net tape extending along a top of the net mesh portion and a lower net tape extending along a bottom of the net mesh portion. The system further including a releasable first net clamp and releasable second net clamp secured to the second net end sleeve, wherein the releasable first net clamp is selectably engageable with the upper net tape and the releasable second net clamp is selectably engageable with the lower net tape, and wherein the net mesh portion is securable with the releasable first net clamp and releasable second net clamp.

8 Claims, 6 Drawing Sheets

(56) References Cited

U.S. PATENT DOCUMENTS

| | | | | |
|---|---|---|---|---|
| 2,280,376 | A | 4/1942 | Clark | |
| 2,569,007 | A | 9/1951 | Klyce | |
| 2,595,725 | A | 5/1952 | Sutton | |
| 3,452,985 | A | 7/1969 | Dmura | |
| 3,717,343 | A | 2/1973 | Hartford | |
| 3,819,182 | A | 6/1974 | Lersch | |
| 3,891,210 | A | 6/1975 | Van Horne | |
| 4,022,471 | A | 5/1977 | Keller | |
| 4,037,838 | A | 7/1977 | Mccune | |
| 4,135,716 | A * | 1/1979 | Ginsburg | A63B 61/04 473/416 |
| 4,147,347 | A | 4/1979 | Mctory | |
| 4,176,842 | A | 12/1979 | Zaldivar | |
| D254,018 | S | 1/1980 | Malm et al. | |
| 4,284,277 | A | 8/1981 | Leonard et al. | |
| 4,336,942 | A | 6/1982 | Warehime | |
| 4,372,561 | A | 2/1983 | Volleyball | |
| 4,433,838 | A | 2/1984 | Gordon | |
| 4,576,364 | A | 3/1986 | O'Fearna | |
| 4,650,189 | A | 3/1987 | Rajacich | |
| 4,715,598 | A | 12/1987 | Knight | |
| 4,720,112 | A | 1/1988 | Stettner et al. | |
| 4,772,018 | A | 9/1988 | Inniger | |
| 4,775,152 | A | 10/1988 | Roehl | |
| 4,948,149 | A | 8/1990 | Lin | |
| 4,962,935 | A | 10/1990 | Williams | |
| 5,014,983 | A | 5/1991 | Saunders | |
| 5,052,686 | A * | 10/1991 | Pryor | A63B 61/003 473/494 |
| D329,063 | S | 8/1992 | Kantor | |
| 5,217,230 | A | 6/1993 | Judd | |
| 5,290,043 | A | 3/1994 | Vidinic | |
| 5,303,932 | A | 4/1994 | Kessler | |
| 5,393,051 | A * | 2/1995 | Merino | A63B 61/003 473/494 |
| 5,472,212 | A | 12/1995 | Bercaw | |
| 5,549,304 | A | 8/1996 | Davis | |
| 5,575,471 | A | 11/1996 | Robinson | |
| 5,645,259 | A | 7/1997 | Chen | |
| 5,655,979 | A | 8/1997 | Blue | |
| 5,674,139 | A | 10/1997 | Brooks | |
| 5,730,442 | A | 3/1998 | Anderson | |
| 5,833,559 | A | 11/1998 | Appelbaum | |
| 5,989,130 | A | 11/1999 | Macaluso | |
| 6,007,438 | A | 12/1999 | Harrell | |
| 6,073,894 | A | 6/2000 | Chen | |
| 6,079,338 | A | 6/2000 | Yeh | |
| 6,485,373 | B1 | 11/2002 | Stephens | |
| 6,564,402 | B1 | 5/2003 | Lin | |
| 6,802,789 | B1 | 10/2004 | Ishino | |
| 6,807,999 | B1 | 10/2004 | Bowen et al. | |
| 6,966,852 | B2 | 11/2005 | Yoon | |
| 7,137,911 | B2 | 11/2006 | Giegerich | |
| 7,156,763 | B1 | 1/2007 | Liao | |
| 7,229,128 | B2 | 6/2007 | Lee | |
| 7,367,907 | B1 | 5/2008 | Sutton et al. | |
| D585,949 | S | 2/2009 | Gaudin et al. | |
| 7,485,053 | B2 | 2/2009 | Nally | |
| 7,608,000 | B2 | 10/2009 | Butler | |
| 7,727,091 | B2 | 6/2010 | Allen | |
| 7,841,958 | B2 | 11/2010 | Fleming et al. | |
| 8,062,153 | B2 | 11/2011 | Boseman | |
| 8,074,669 | B2 | 12/2011 | Collins et al. | |
| 8,100,784 | B2 | 1/2012 | Conforti | |
| 8,122,536 | B2 | 2/2012 | Peixin et al. | |
| 8,245,332 | B2 | 8/2012 | Yul et al. | |
| 666,464 | A1 | 9/2012 | Austin | |
| 8,641,562 | B1 | 2/2014 | Tuttle | |
| 9,504,892 | B2 | 11/2016 | Saphire | |
| 2002/0005512 | A1 | 1/2002 | Trill | |
| 2004/0005941 | A1 | 1/2004 | Chen | |
| 2004/0132558 | A1 | 7/2004 | Rothman | |
| 2004/0214666 | A1 | 10/2004 | Dilling | |
| 2006/0237575 | A1 * | 10/2006 | Van Hierden | A63B 61/00 242/406 |
| 2007/0087869 | A1 * | 4/2007 | Lin | A63B 61/02 473/492 |
| 2007/0228349 | A1 | 10/2007 | Smith | |
| 2008/0067751 | A1 | 3/2008 | Hunt | |
| 2009/0260666 | A1 | 10/2009 | Zheng | |
| 2010/0175731 | A1 | 7/2010 | Day | |
| 2011/0177893 | A1 | 7/2011 | Abramson | |
| 2013/0005515 | A1 | 1/2013 | Saphire | |
| 2017/0113110 | A1 * | 4/2017 | Morton | F16B 2/06 |
| 2018/0015343 | A1 * | 1/2018 | Orenstein | A63B 61/003 |
| 2020/0023255 | A1 | 1/2020 | Webb et al. | |
| 2022/0193512 | A1 * | 6/2022 | Callender, Jr. | A63B 61/02 |

FOREIGN PATENT DOCUMENTS

| | | | | |
|---|---|---|---|---|
| CN | 111184987 A | * | 5/2020 | |
| DE | 2321436 | | 11/1974 | |
| DE | 2846142 | | 4/1980 | |
| DE | 19916622 | | 10/1999 | |
| EP | 0242009 | | 10/1987 | |
| EP | 0329585 | | 8/1989 | |
| EP | 1614452 | | 1/2006 | |
| FR | 1350554 | | 1/1964 | |
| FR | 2694704 | | 2/1994 | |
| FR | 2794658 | | 12/2000 | |
| FR | 2815261 | | 4/2002 | |
| FR | 2954170 | | 6/2011 | |
| GB | 400850 | | 11/1933 | |
| GB | 978069 | | 12/1964 | |
| GB | 2448989 | | 11/2011 | |
| JP | 2000140178 | | 5/2000 | |
| KR | 200282197 | | 7/2002 | |
| KR | 200482421 Y1 | * | 2/2017 | A63B 61/00 |

OTHER PUBLICATIONS

Dick's Sporting Goods advertisement dated Dec. 10, 2018.
Dick's Sporting Goods advertisement dated Dec. 17, 2018.
Dick's Sporting Goods advertisement dated Dec. 3, 2018.
Preliminary Report for French Patent Publication No. 2815261 dated Aug. 30, 2001.
Preliminary Report for French Patent Publication No. 2694704 dated May 10, 1993.

* cited by examiner

ADJUSTABLE NET SYSTEM

CROSS-REFERENCE TO RELATED APPLICATIONS

This application claims the benefit of and priority to U.S. Provisional Patent Application Ser. No. 63/267,667 filed on Feb. 8, 2022, the contents of which are incorporated herein by reference in their entirety.

FIELD OF THE INVENTION

The described embodiments relate generally to the field of sports and games. More particularly, the described embodiments relate to net assemblies for sports and games.

BACKGROUND OF THE INVENTION

Nets for sports and games have traditionally been sold with a fixed net size. This fixed net size can limit the use of such nets. For example, in some instances the net is too big for the space it is intended to be used in. Another example is fewer or more participants wish to play the sport or game. Adjusting the size of traditional nets can result in reduced game play or even damage to the net.

BRIEF SUMMARY

In at least some embodiments, the disclosed is an adjustable net system including a net having a first net end and a second net end, with a net mesh portion extending therebetween, wherein the net extends a distance between the first net end and the second net end; a first net end sleeve having a first post pocket situated at the first net end and a second net end sleeve having a second post pocket situated at the second net end; an upper net tape extending along a top of the net mesh portion and a lower net tape extending along a bottom of the net mesh portion; a releasable first net clamp and a releasable second net clamp secured to the second net end sleeve opposite the second post pocket, wherein the releasable first net clamp is selectably engageable with the upper net tape and the releasable second net clamp is selectably engageable with the lower net tape, and wherein the net mesh portion is foldable upon itself and securable with the releasable first net clamp and releasable second net clamp to decrease the distance between the first net end and the second net end; and a pair of net support stands, including a first net support stand and a second net support stand for engaging the first net end sleeve and second net end sleeve respectively.

In at least some other embodiments, disclosed is an adjustable net system including a net having a first net end and a second net end, with a net mesh portion extending therebetween, wherein the net extends a distance between the first net end and the second net end; a first net end sleeve situated at the first net end and a second net end sleeve situated at the second net end; an upper net tape extending along a top of the net mesh portion and a lower net tape extending along a bottom of the net mesh portion; a releasable first net clamp and a releasable second net clamp secured to the second net end sleeve, wherein the releasable first net clamp is selectably engageable with the upper net tape and the releasable second net clamp is selectably engageable with the lower net tape, and wherein the net mesh portion is foldable upon itself and securable with the releasable first net clamp and releasable second net clamp to decrease the distance between the first net end and the second net end.

Other embodiments, aspects, features, objectives and advantages of the invention will be understood and appreciated upon a full reading of the detailed description and the claims that follow.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals may be used to indicate like components. In the drawings.

DETAILED DESCRIPTION

Figure 1:
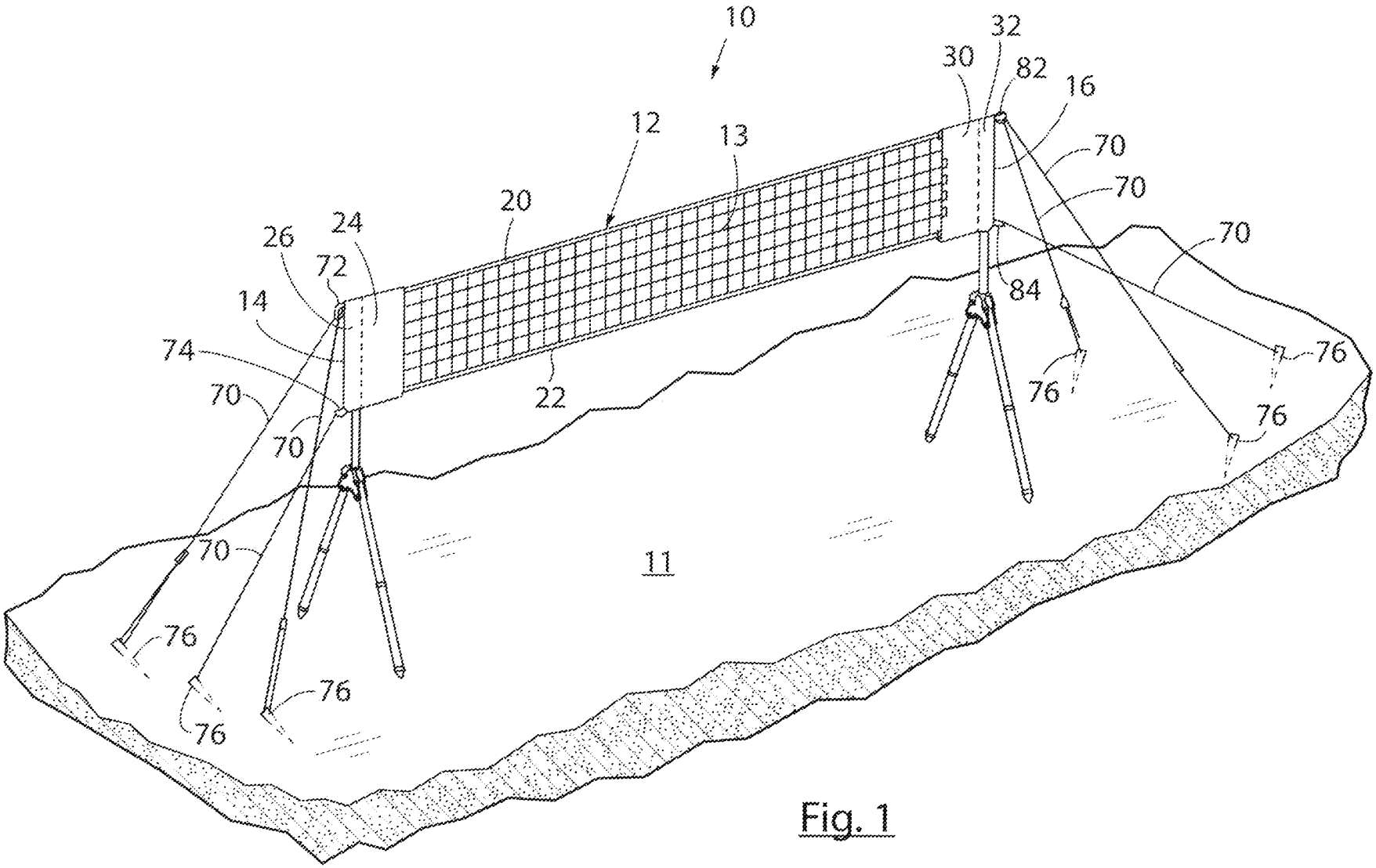
FIG. 1 is a perspective view of an exemplary embodiment of an adjustable net system in a fully assembled position on a representative ground surface.
Figure 2:
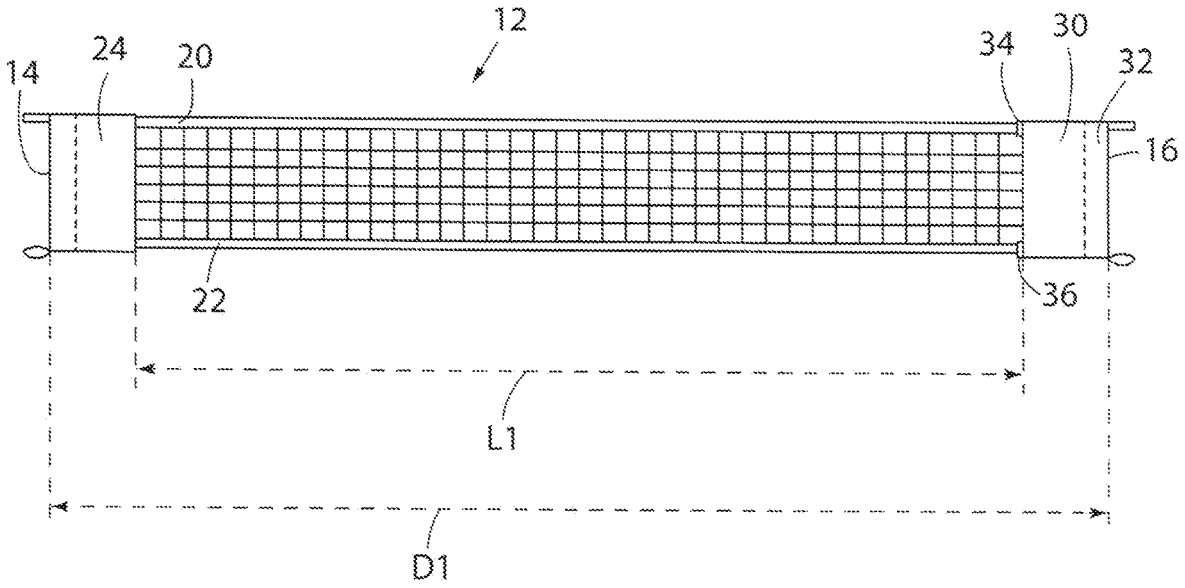
FIG. 2 is a front elevation view of the net of FIG. 1 shown in a fully extended configuration.
Figure 3:
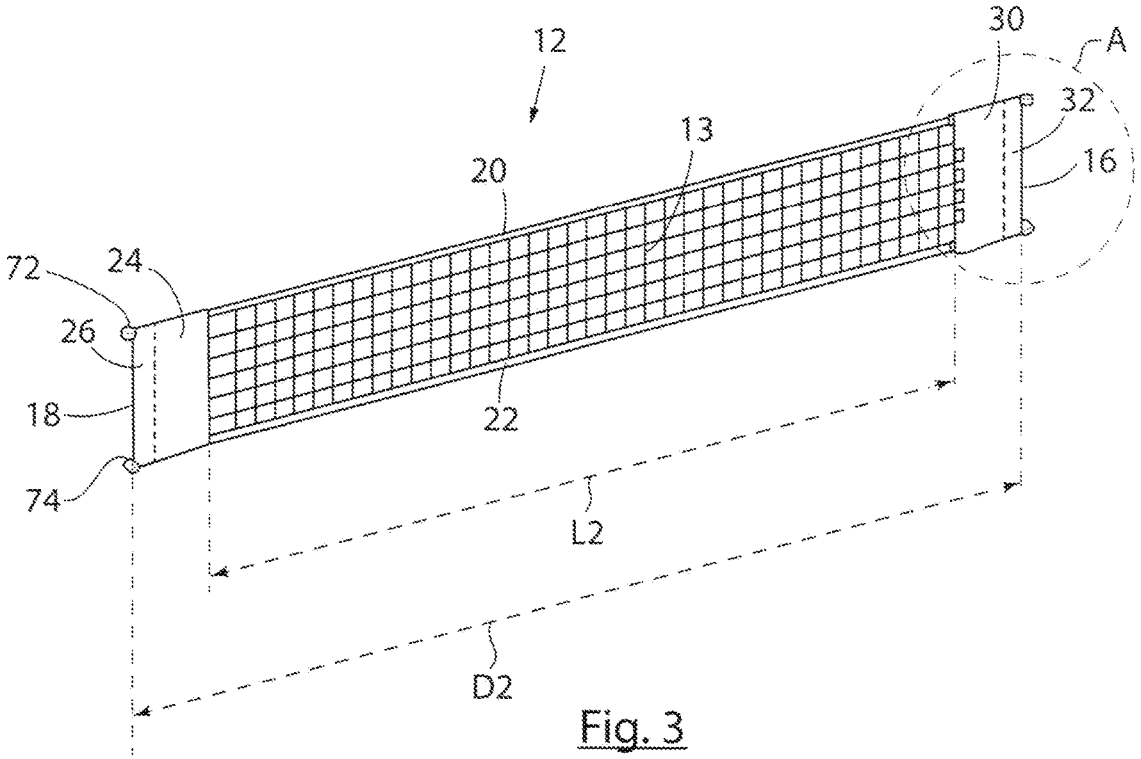
FIG. 3 is a front perspective view of the net of FIG. 1 shown in a selectably reduced length configuration.

Referring to FIG. 1, a perspective view of an exemplary embodiment of an adjustable net system 10 secured to a representative ground surface 11 is provided. Additionally referring to FIG. 2, the adjustable net system 10 includes a net 12 that in a fully extended configuration, extends a distance D1 between a first net end 14 and a second net end 16. The net 12 is generally sized for use in sports, such as volleyball and badminton and includes a net mesh portion 13 having a width and length suitable for such sports, although the net dimensions can vary to suit different applications. The distance D1 that the net 12 extends, can be reduced as shown in FIG. 3. More particularly, the net 12 includes a net mesh portion 13 situated between the first net end 14 and a second net end 16 and having an exposed length that can be adjusted between a fully extended net length L1 (FIG. 2) and a selectably reduced (folded) length L2 (FIG. 3), as discussed in detail below. Selectably reducing the exposed length of the net mesh portion 13 reduces the distance D1 to a shorter distance D2. In this manner, the overall width of the net 12 can be adjusted to best accommodate a particular sport or playing area. For example, reducing the width allows easier play when only two players are available for a typical four or more player game.

Figure 4:
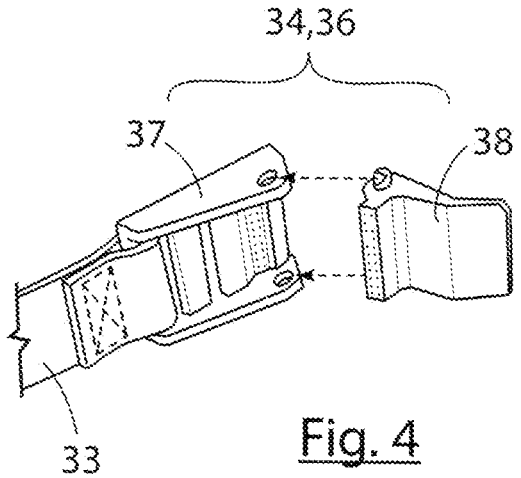
FIG. 4 is a perspective exploded view of an exemplary net clamp of FIG. 1.

An upper net tape 20 extends along a top of the net mesh portion 13 and a lower net tape 22 extends along a bottom of the net mesh portion 13. The upper net tape 20 and lower net tape 22 can be comprised of any of various materials and are commonly found on known sports net configurations. The net 12 further includes a first net end sleeve 24, which can take many forms, and in at least some embodiments includes a first post pocket 26 situated at the first net end 14, and a second net end sleeve 30, which can take many forms. and in at least some embodiments includes a second post pocket 32 situated at the second net end 16. The first post pocket 26 and second post pocket 32 can take many forms, although in at least some embodiments, they are formed by overlapping portions sewn along a vertical line to provide an expandable passage. The second net end sleeve 30 provides for adjustability of the exposed length of the net mesh portion 13, which in turn increases or decreases the distance between the first net end 14 and the second net end 16. More particularly, referring to FIGS. 4-7, a plurality of net clamps are secured to the second net end sleeve 30 opposite the second post pocket 32 (see FIGS. 5-7). An exemplary net clamp illustrated in FIG. 4, includes a strap base portion 37 (for receiving the net tape) and a rotatable lever portion 38 that is rotated downward to engage and secure the net tape between the strap base portion 37 and lever portion 38. In at least some embodiments, the net clamps can be secured to the second net end sleeve 30 using a fabric strap, such as strap 33 as seen in FIG. 4, which is then sewn to the second net end sleeve 30.

Figure 5:
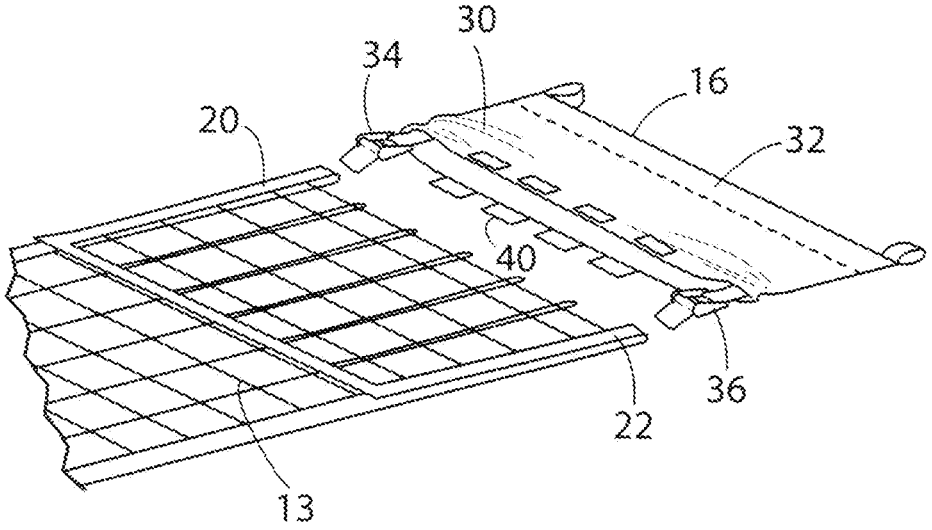
FIG. 5 is a view of portion A of the net of FIG. 3 shown in a first pre-assembly state.
Figure 6:
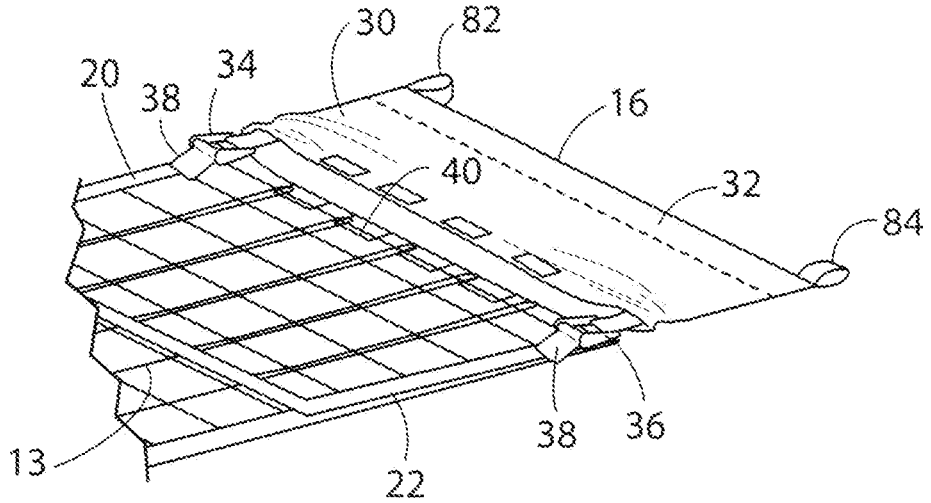
FIG. 6 is a view of portion A of the net of FIG. 3 shown in a second pre-assembly state.
Figure 7:
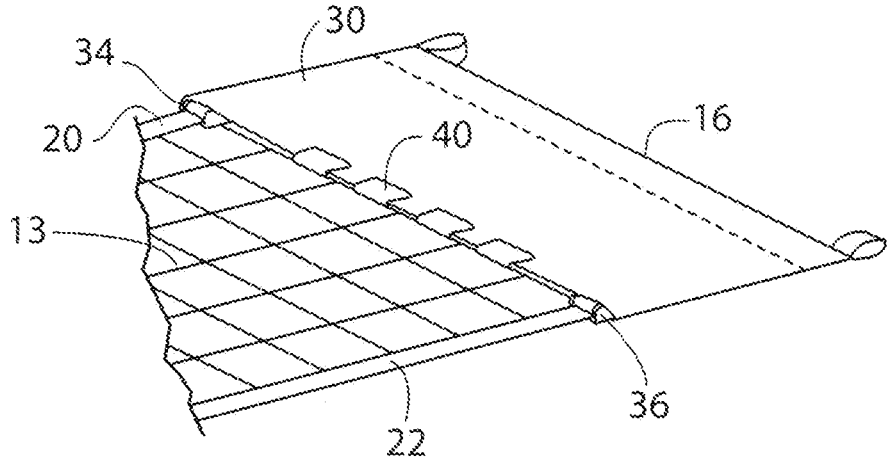
FIG. 7 is a view of portion A of the net of FIG. 3 shown in a final assembled state providing a reduced length.
Figure 8:
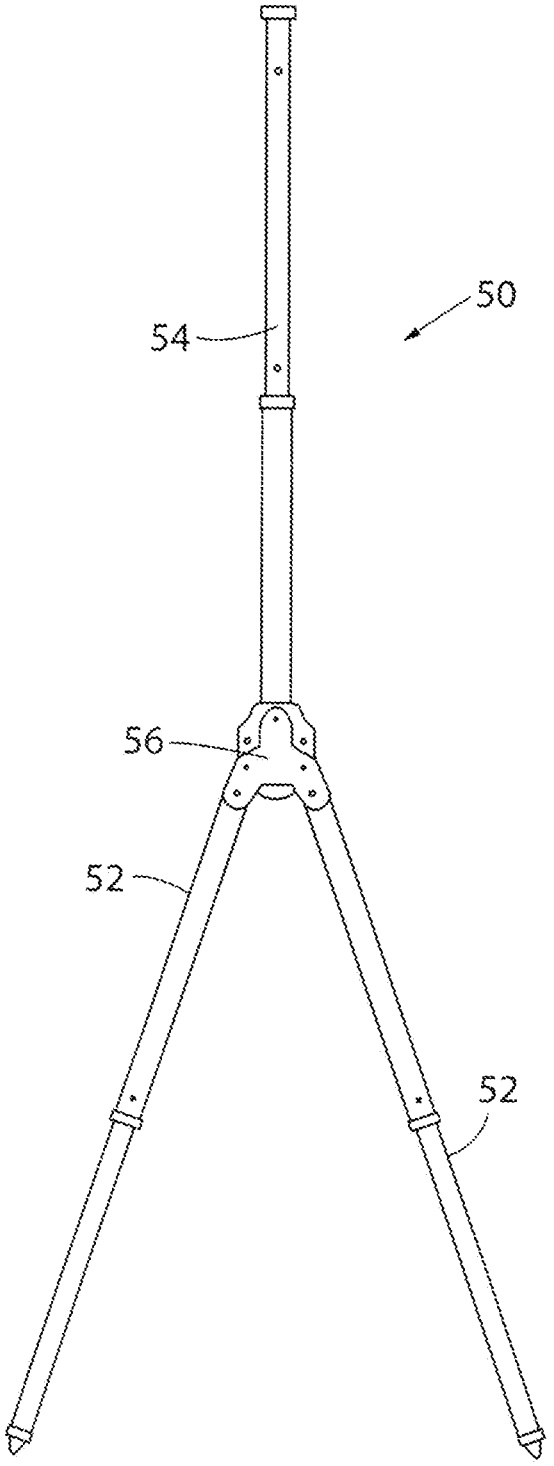
FIG. 8 is a side elevation view of the net stand of FIG. 1 in a fully extended state.

In at least some embodiments, the plurality of net clamps includes a first releasable net clamp 34 and a second releasable net clamp 36, wherein the first releasable net clamp 34 is selectably engageable with the upper net tape 20 and the second releasable net clamp 36 is selectably engageable with the lower net tape 22, and wherein the net mesh portion 13 is foldable upon itself to a shortened (folded) length L2 for securement to the net clamps 34, 36. As seen in FIGS. 5-7 depicting partial views of the net 12 of FIG. 3 (net mesh portion 13 is folded to reduce overall length) in various states of assembly, once the net mesh portion 13 has been folded along the upper net tape 20 and lower net tape 22 to the desired length L2, the folded upper net tape 20 is inserted into the first releasable net clamp 34 and the first releasable net clamp 34 is closed to secure the upper net tape 20 to the second net end sleeve 30. Similarly, the folded lower net tape 22 is inserted into the second releasable net clamp 36 and the second releasable net clamp 36 is closed to secure the lower net tape 22 to the second net end sleeve 30. The excess net mesh can be inserted and stored inside the second net end sleeve 30 and a plurality of releasably fastenable tabs 40 (Velcro, etc.) can be folded over vertical portions of the net mesh portion 13 to further secure it.

Figure 9:
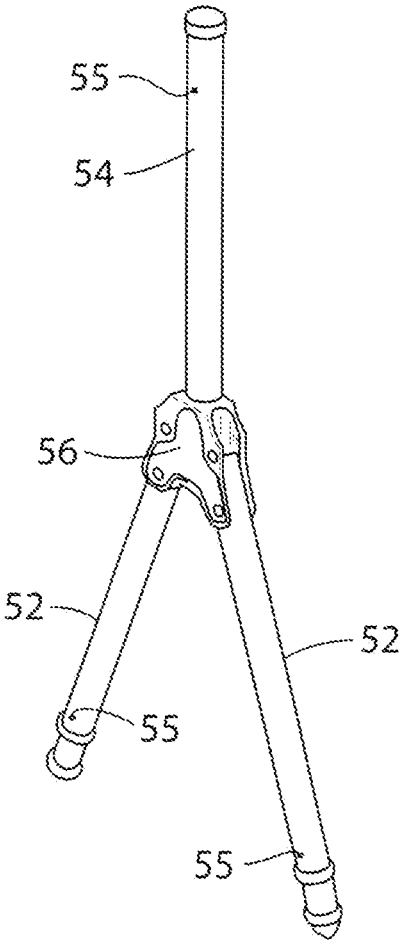
FIG. 9 is a perspective view of the net stand of FIG. 8 in a partially collapsed state.

Referring now to FIGS. 8-11, after the net 12 has been adjusted to the desired length it is vertically supported on opposite sides with a pair of net support stands 50. The net support stands can take many forms, in at least some embodiments, each net support stand includes a plurality of support legs 52 and a net post 54, while in further embodiments, the net support stands can be a singular post that extends between the ground and the net 12 at either end of the net. Further in at least some embodiments, the support legs 52 and net post 54 can by at least partially tubular, including multi-sectioned telescoping elements that can be collapsed or expanded by using selectably engaging locking tabs 55 in order to increase portability (see FIG. 9 illustrating the support legs 52 and net post 54 in a telescopically collapsed position). Interconnected telescoping tubes with locking tabs for other uses are generally well known and therefore not discussed in further detail here. The net post 54 is sized and shaped to be received in the first post pocket 26 to support one side of the net 12 and received in the second post pocket 32 to support the other side of the net 12.

Figure 10:
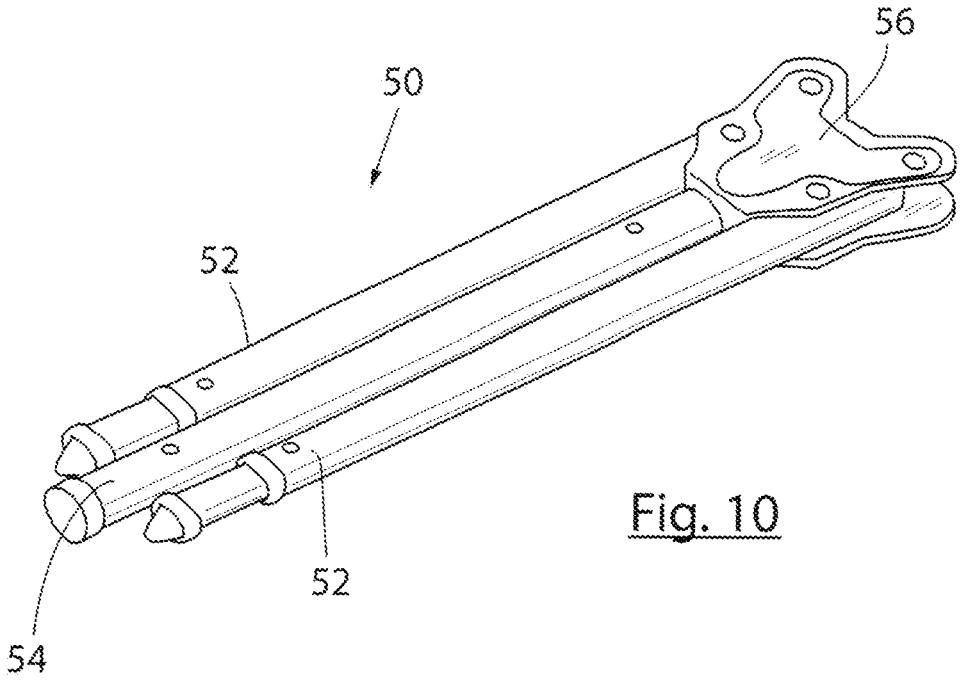
FIG. 10 is a perspective view of the net stand of FIG. 8 in a fully collapsed state.
Figure 11:
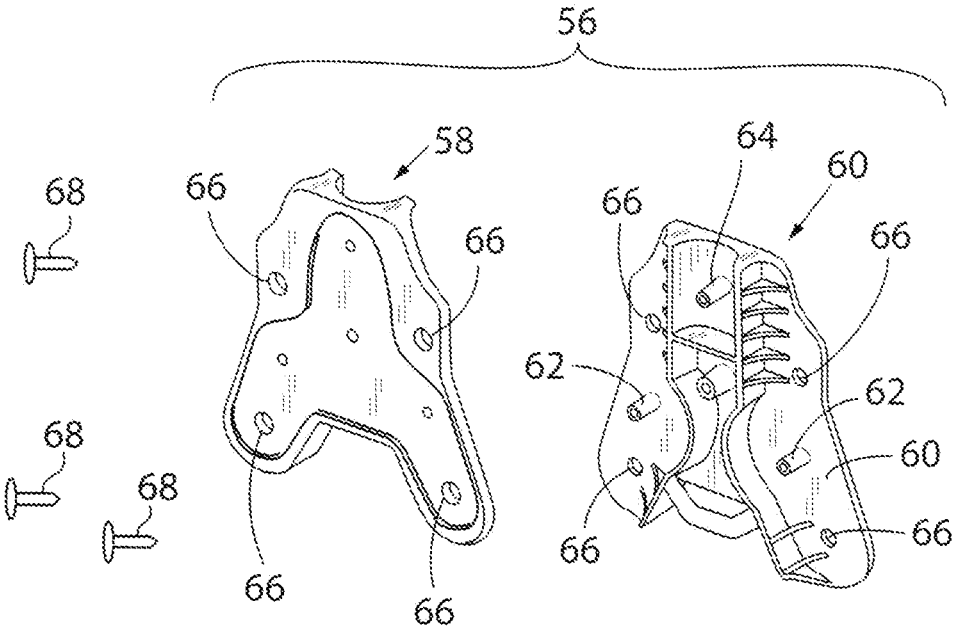
FIG. 11 is an exploded perspective view of the central coupler of the net stand of FIG. 8.

In at least some embodiments, the net support stand 50 can include a central coupler 56 that interconnects the support legs 52 and the net post 54, and further facilitates a folding position with the support legs 52 parallel to the net post 54 for portability, such as seen in FIG. 10. Although the central coupler 56 can take many forms, FIG. 11 illustrates an exemplary embodiment of the central coupler 56 that includes a front plate 58 and a back plate 60, wherein the back plate 60 includes first posts 62 for rotatably coupling the support legs 52, and a fixed post 64 for securing the net post 54. A plurality of apertures 66 can be provided for receiving and engaging the locking tabs 55 on the support legs 52 to allow for movement between collapsed and expanded positions. The front plate 58 and back plate 60 can be secured together using a plurality of fasteners, such as screws 68.

To further stabilize the net 12, the adjustable net system 10 includes a plurality of separate support ropes 70 coupled to the first net end 14, wherein in at least some embodiments, the first net end sleeve 24 includes a primary support tab 72 (e.g., grommet, loop, ring, etc.) at the top of the first net end sleeve 24 and a secondary support tab 74 at the bottom of the first net end sleeve 24, the support ropes 70 being couplable to the primary support tab 72 and secondary support tab 74 and staked to the ground using ground stakes 76. Similarly, the second net end sleeve 30 can include a primary support tab 82 (e.g., grommet, loop, ring, etc.) at the top of the second net end sleeve 30 and a secondary support tab 84 at the bottom of the second net end sleeve 30, with separate support ropes 70 being couplable to the primary support tab 82 and secondary support tab 84 and staked to the ground using ground stakes 76.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of any appended claims and the description of the invention herein. It shall be understood that the phrase "a plurality" shall include one or more.

I claim:

1. An adjustable net system comprising:

a net having a first net end and a second net end, with a net mesh portion extending therebetween, wherein the net extends a distance between the first net end and the second net end;

a first net end sleeve having a first post pocket situated at the first net end and a second net end sleeve having a second post pocket situated at the second net end;

an upper net tape extending along a top of the net mesh portion and a lower net tape extending along a bottom of the net mesh portion;

a releasable first net clamp and a releasable second net clamp secured to the second net end sleeve opposite the second post pocket, wherein the releasable first net clamp is selectably engageable with the upper net tape and the releasable second net clamp is selectably engageable with the lower net tape, and wherein the net mesh portion is foldable upon itself and securable with the releasable first net clamp and releasable second net clamp to decrease the distance between the first net end and the second net end; and a pair of net support stands, including a first net support stand and a second net support stand for engaging the first net end sleeve and second net end sleeve respectively.

2. The adjustable net system of claim 1, wherein the first net support stand includes a first net post insertable into the first post pocket, and a plurality of interconnected first stand legs.

3. The adjustable net system of claim 2, wherein the second net support stand includes a second net post insertable into the second net pocket, and a plurality of interconnected second stand legs.

4. The adjustable net system of claim 3, wherein the first net support stand and second net support stand are collapsible.

5. The adjustable net system of claim 4, wherein the first net support stand includes a central coupler pivotably connecting the plurality of first stand legs to the first net post.

6. The adjustable net system of claim 2, wherein the first post pocket extends vertically along the height of the first net end sleeve and the second post pocket extends vertically along the height of the second net end sleeve.

7. The adjustable net system of claim 6, further comprising a plurality of support ropes coupled to the first net end sleeve and the second net end sleeve and configured to be secured adjacent the ground surface with respective ground stakes.

8. An adjustable net system comprising:

a net having a first net end and a second net end, with a net mesh portion extending therebetween, wherein the net extends a distance between the first net end and the second net end;

a first net end sleeve situated at the first net end and a second net end sleeve situated at the second net end;

an upper net tape extending along a top of the net mesh portion and a lower net tape extending along a bottom of the net mesh portion; and a releasable first net clamp and a releasable second net clamp secured to the second net end sleeve, wherein the releasable first net clamp is selectably engageable with the upper net tape and the releasable second net clamp is selectably engageable with the lower net tape, and wherein the net mesh portion is foldable upon itself and securable with the releasable first net clamp and releasable second net clamp to decrease the distance between the first net end and the second net end.

* * * * *